United States Patent [19]

Moore et al.

[11] Patent Number: 4,481,088

[45] Date of Patent: Nov. 6, 1984

[54] REMOVAL OF CHLORATE FROM ELECTROLYTE CELL BRINE

[75] Inventors: Sanders H. Moore; Ronald L. Dotson, both of Cleveland, Tenn.

[73] Assignee: Olin Corporation, New Haven, Conn.

[21] Appl. No.: 395,753

[22] Filed: Jul. 6, 1982

[51] Int. Cl.[3] ..... C25B 1/16

[52] U.S. Cl. ..... 204/98; 204/128

[58] Field of Search ..... 204/98, 128, 129, 130

[56] References Cited

U.S. PATENT DOCUMENTS

| | | | |
|---|---|---|---|
| 3,920,529 | 11/1975 | Sprague | 204/128 |
| 3,970,528 | 7/1976 | Zirngiebl et al. | 204/98 |
| 4,169,773 | 10/1979 | Lai et al. | 204/98 |
| 4,247,375 | 1/1981 | Lohrberg | 204/98 |
| 4,272,338 | 6/1981 | Lynch et al. | 204/98 |

FOREIGN PATENT DOCUMENTS

| | | | |
|---|---|---|---|
| 0110998 | 9/1978 | Japan | 204/98 |

OTHER PUBLICATIONS

Dotson, Ronald L., "Kinetics and Mechanism for the Thermal Decomposition of Chlorate Ions in Brine Acidified with Hydrochloric Acid", *J. Appl. Chem. Biotechnol.,* 1975, 25, pp. 461–464.

*Primary Examiner*—R. L. Andrews
*Assistant Examiner*—Terryence Chapman
*Attorney, Agent, or Firm*—James B. Haglind; Donald F. Clements

[57] ABSTRACT

A process for removing chlorate ions from a recirculating anolyte brine as typically used in membrane chlor-alkali cells is disclosed. In this, a portion of the circulating brine after dechlorination and resaturation with additional alkali metal chloride is diverted and treated with a stoichiometric amount of hydrochloric acid to convert substantially all of the chlorate to chlorine gas and chloride ion. When performed in this manner, substantially lower quantities of acid are required as compared to prior art processes and the problems with the generation of $ClO_2$ are minimized.

8 Claims, 1 Drawing Figure

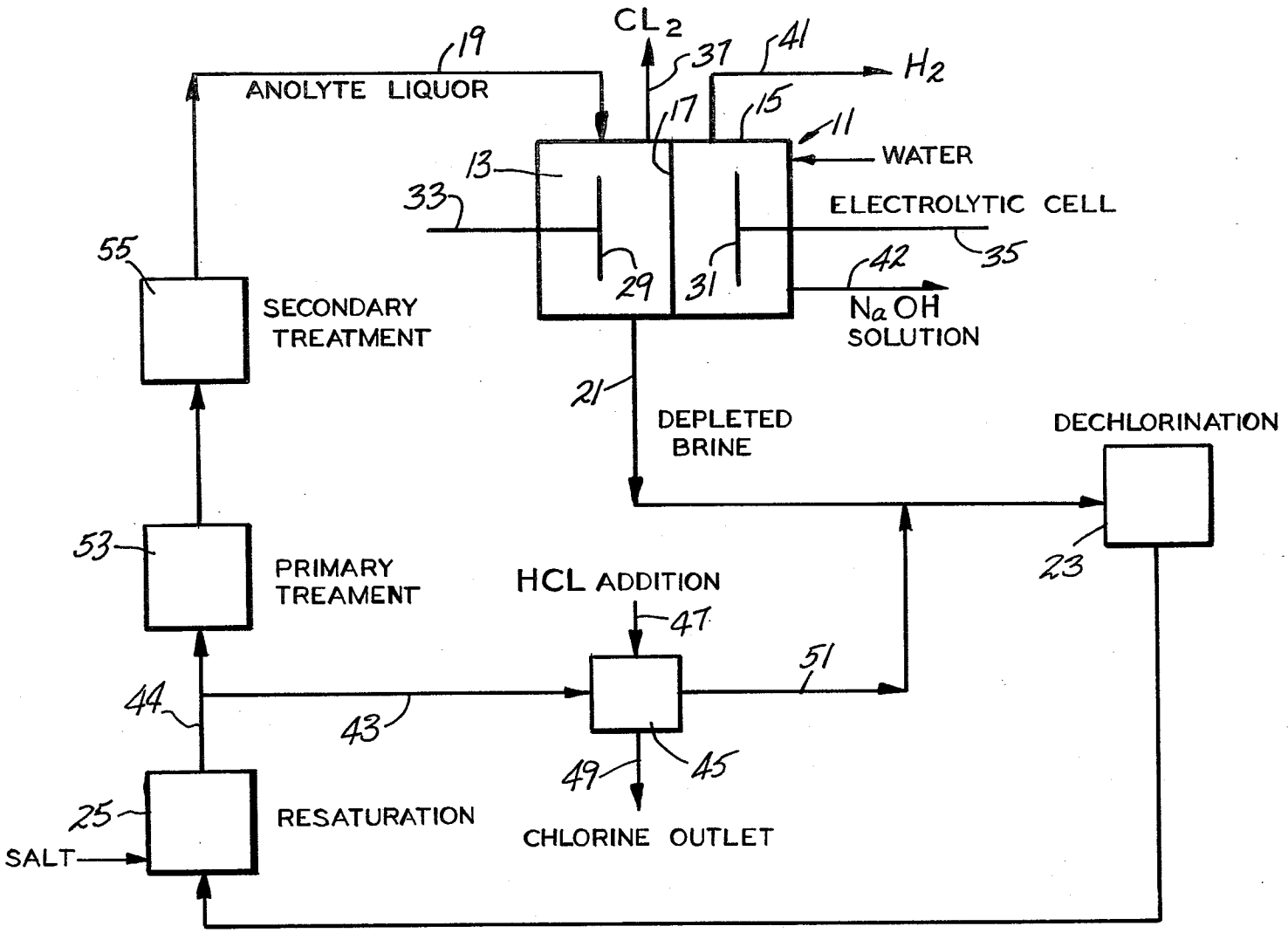
DECHLORINATION
23
ELECTROLYTIC CELL
35
WATER
$H_2$
42
NaOH SOLUTION
11
41
15
37
31
$CL_2$
17
29
DEPLETED BRINE
51
HCL ADDITION
47
45
CHLORINE OUTLET
21
49
19
13
33
ANOLYTE LIQUOR
SECONDARY TREATMENT
PRIMARY TREAMENT
43
RESATURATION
55
53
44
25
SALT

REMOVAL OF CHLORATE FROM ELECTROLYTE CELL BRINE

BACKGROUND OF THE INVENTION

The present invention relates to a method for purifying an alkali metal halide brine used in the electrolytic production of high purity alkali metal hydroxide solutions and more particularly to an improved process for removing chlorate ions therefrom. The alkali metal chloride brines used in the present invention are produced along in halide utilizing electrolytic cells by the passage of an electric current through said alkali metal halide brine. Electrolytic cells are commonly employed commercially for the conversion of alkali metal halide into alkali metal hydroxide and halide, fall into one of three general types—diaphragm, mercury and membrane cells.

Diaphragm cells utilize one or more diaphragms permeable to the flow of electrolyte solution but impervious to the flow of gas bubbles. The diaphragm separates the cell into two or more compartments. Further imposition of a decomposing current, halide gases, given off at the anode, and hydrogen gas along with an alkali metal hydroxide are formed in the cathode. Although the diaphragm cell achieves relatively high production per unit floor space, at low energy requirement and at generally high current efficiency, the alkali metal hydroxide product, or cell liquor, from the catholyte compartment is both dilute and impure. The product may typically contain about 12% by weight of alkali metal hydroxide along with about 12% by weight of the original, unreacted alkali metal chloride. In order to obtain a commercial or salable product, the cell liquor must be concentrated and purified. Generally, this is accomplished by evaporation. Typically, the product from the evaporator is about 50% by weight alkali metal hydroxide containing about 1% by weight alkali metal chloride.

Mercury cells typically utilize a moving or flowing bed of mercury as the cathode and produce an alkali metal amalgam from the mercury cathode. Halide gas is produced at the anode. The amalgam is withdrawn from the cell and treated with water to produce a concentrated high purity alkali metal hydroxide solution. Although mercury cell installations have many disadvantages including a high initial capital investment, undesirable ratio of floor space per unit of product and negative ecological considerations, the purity of the alkali metal hydroxide product is an inducement to its continued use. Typically, the alkali metal hydroxide product contains less than about 0.05% by weight of contaminating foreign ions.

Membrane cells utilize one or more membranes or barriers separating the catholyte and anolyte compartments in the cell. These membranes are permselective; that is, they are generally permeable to either anions or cations. Generally, the permselective membranes utilized are cationically permselective. In membrane cells employing a single membrane, the membrane may be porous or non-porous. The membrane cells employing two or more membranes, porous membranes are usually utilized closest to the anode and non-porous membranes are usually utilized closest to the cathode. The catholyte product of the membrane cell is a relatively high purity alkali metal hydroxide. Catholyte cell liquor from a membrane cell is purer and has a higher caustic concentration than the product of the diaphragm cell.

It has been the objective, but frequently not the result, for diaphragm and membrane cells to produce "rayon grade" alkali metal hydroxide, that is, a product having a contamination of less than about 0.5% of the original salt. Diaphragm cells have not been able to produce such a product directly, because anions of the original salt freely migrate into the catholyte compartment of the cell. Membranes cells do have the capability to produce such a high quality alkali metal hydroxide product. However, one problem encountered in the operation of such cells is the production of chlorate in the anolyte compartment which will not readily pass through a cation, permselective membrane. Accordingly, chlorates concentrate in the anolyte, and after brief period of operation, may reach objectionable concentration levels. While chlorates are not known to cause rapid deterioration of membrane or anode structures, high concentrations thereof do tend to reduce the solubility of the salt resulting in decreased efficiencies, possible salt precipitation and potentially adverse chlorate concentrations in the caustic product.

In the past, removal of chlorate from diaphragm cell liquor has been handled in a number of ways. For example, Johnson, in U.S. Pat. No. 2,790,707, teaches removal of chlorates and chlorides from diaphragm cell liquor by formation of iron salts by adding ferrous sulfate. Osborne, in U.S. Pat. No. 2,823,177, teaches the prevention of chlorate formation during electrolysis of alkali metal chloride in diaphragm cells by destruction of hypochlorite through distribution of catalytic amounts of nickel or cobalt in the diaphragm. It is noteworthy that considerable effort has been expended in chlorate removal from catholyte cell liquor, a highly alkaline medium. In such a solution, chlorate ion is quite stable and therefore tends to persist in the cell effluent and to pass on through to the evaporators in which the caustic alkalis are concentrated. Practically, all of the chlorate survives this evaporation and remains in the final product where it constitutes a highly objectionable contaminant, especially to the rayon industry.

The problem of lowering chlorates in diaphragm cells has been attacked at two main points:

(a) the chlorates having been formed, can be reduced in the further processing of the caustic alkali and by special treatments; or (b) production of chlorates during electrolysis can be lowered by adding a reagent to the brine feed which reacts preferentially with the back migrating hydroxyl ions from the cathode compartment of the cell making their way through the diaphragm into the anolyte compartment, and by such a reaction, prevents the formation of some of the hypochlorites and thus additionally preventing these hypochlorites from further reacting to form chlorates. Reagents such as hydrochloric acid or sulfur in an oxidizable form, such as sodium tetrasulfide, have been used to attack this problem.

In membrane cell operation, it is conventional to recycle spent brine from the anolyte compartment for resaturation. Satisfactory operation can be achieved so long as the chlorate concentration in the anolyte brine stream is kept below about 1.0% (i.e., about 10 g/l). In modern cells, the chlorate concentration buildup during the normal residence time of the anolyte brine solution therein is about 0.1% per pass. Thus, if the initial chlorate content in the anolyte brine is acceptable, it is not necessary to remove all the chlorate present but only enough to remove the additional chlorate formed in the cell during this residence time to keep the brine within usable limits. In the past, removal of chlorate sufficient to keep the brine satisfactory has been accomplished by purging a portion of the depleted brine and adding fresh brine as makeup. In many facilities, the purged chlorate containing brine is often used as feedstock in a separate chlorate cell.

More recently, Lai et al. in U.S. Pat. No. 4,169,773 have shown that chlorate concentrations in the circulating brine stream are significantly reduced by reacting a portion of said stream prior to dechlorination, with a strong acid such as HCl to produce additional chlorine, water and salt. In this procedure, substantially all the chlorate therein is removed therefrom, so that when said depleted portion is added back to the main stream, the average chlorate value is within acceptable limits. However, the system used by Lai et al. calls for a separate dechlorination subsystem for the treated brine which adds both to the complexity and costs for chlorate removal. What is needed is a simpler, less expensive procedure for chlorate removal for recirculating brine streams used in membrane cells. As shown by Dotson in "Kinetics and Mechanism for the Thermal Decomposition of Chlorate Ions in Brine Acidified with Hydrochloric Acid", *J. Appl. Chem. Biotechnol.*, 1975, 25, 461–464, chlorate removal rate is a function of the chloride ion content and the higher this value, the more efficient is the process for chlorate removal.

SUMMARY OF THE INVENTION

The present invention relates to a method for direct treatment of the recirculating anolyte alkali metal halide liquor in a membrane cell to effectively reduce the chlorate content therein after dechlorination and resaturation. Although the process of the present invention may be utilized in the electrolysis of any alkali metal halide, sodium chloride is preferred and is normally the alkali metal halide used. However, other alkali metal chlorides may be utilized, such as potassium chloride or lithium chloride.

The present invention comprises diverting a portion of the dechlorinated, resaturated circulating anolyte cell liquor of a membrane cell and treating said portion with sufficient acid so as to substantially remove chlorate values therefrom. When this is done, the sodium chlorate content of said portion is converted to chlorine, and salt. After treatment, the acidified solution is dechlorinated and then returned to the cell. Further, by so doing, it is found that such a treatment provides significant cost and operating advantages as compared to previously known methods for chlorate removal.

Therefore, it is the principal object of the present invention to provide an improved method for reducing the chlorate content of a recirculating anolyte liquor used in a membrane cell.

It is a further object of the invention to provide a method for chlorate removal in a recirculating membrane cell anolyte liquor which requires less acid and operates at a higher overall throughput rate as compared to previously known chlorate removal methods.

BRIEF DESCRIPTION OF THE DRAWING

FIG. 1 is a flow diagram for the process of the present invention.

DETAILED DESCRIPTION OF THE INVENTION

The present invention will be described in more detail by the discussion of the accompanying drawing.

Membrane cell 11 is illustrated with two compartments, compartment 13 being the anolyte compartment and compartment 15 being the catholyte compartment. It would be understood that although, as illustrated in the drawing, and in the preferred embodiment, the membrane cell is a two compartment cell, a buffer compartment or a plurality of other buffer compartments may be included. Anolyte compartment 13 is separated from catholyte compartment 15 by cationic permselective membrane 17.

Cell 11 is further equipped with anode 29 and cathode 31, suitably connected to a source of direct current through lines 33 and 35. Upon passage of a decomposing current through cell 11, chlorine is generated at the anode and removed from the cell in gaseous form through line 37 for subsequent recovery. Hydrogen is generated at the cathode and is removed through line 41. Sodium hydroxide formed at the cathode is removed through line 42. Sodium hydroxide product taken from line 42 is substantially sodium chloride free, and generally containing less than 1% by weight of sodium chloride and has a concentration of NaOH in the range of from about 20% to about 40% by weight.

A feed of sodium chloride brine is fed into anolyte compartment 13 of cell 11 by line 19. The sodium chloride brine feed material entering cell 11 generally has from about 250 to about 350 grams per liter sodium chloride content. This solution may be neutral or basic, but is preferably acidified to a pH in the range of from about 1 to about 6, preferably achieved by pretreating it with a suitable acid such as hydrochloric acid. Such pretreatment along with techniques for adjusting the levels of $Ca^{++}$, $Mg^{++}$, $Fe^{30+}$, $SO_4=$ and other impurities are well known and widely used in the art.

Hot depleted sodium chloride brine having a salt content of about 25% by weight and a sodium chlorate content of about 1% by weight is removed by anolyte recirculation line 21 and conveyed first to dechlorination in vessel 23 then to resaturation vessel 25 wherein additional salt sufficient to substantially saturate the brine is added.

The saturated brine stream, coming from resaturation vessel 25, is split into two portions, one portion of from about 10% to about 30% and preferably from about 12% to about 25% of resaturator output 44 being conveyed through line 43 to reactor 45 for chlorate removal by the process of the present invention. Reaction vessel 45 has inlet 47 for the addition of acid and outlet 49 for the removal of gaseous decomposition product. The incoming saturated brine stream contains from about 1 to about 15 grams per liter $NaClO_3$ and NaOCl. After treatment by the process of this invention, the outgoing liquor is substantially free of chlorate ion and has a pH of from about 1 to about 6. Impurities introduced into the brine during resaturation and treatment remain in the recirculating anolyte liquor and must be subsequently removed.

The second portion or remainder of the resaturated fluid is fed through primary and secondary treatment vessels 53 and 55, respectively, wherein calcium and magnesium ions are removed by ion exchange techniques and the pH is finally adjusted to the level required for efficient operation of the cell. Techniques for such primary and secondary treatment are well known in the industry and need not be described in detail.

The reactions which occur in reaction vessel 45 may be represented by the equations:

$$NaClO_3+2HCl \rightarrow ClO_2+\tfrac{1}{2}Cl_2+H_2O+NaCl \quad (1)$$

$$NaClO_3+6HCl \rightarrow NaCl+3Cl_2+3H_2O \quad (2)$$

These two reactions compete in the reaction mixture but reaction (2) is preferred to minimize chlorine dioxide production. To achieve this, it is preferred to operate at or near the stoichiometry of reaction (2), i.e., about 6 moles of acid per mole of $NaClO_3$.

At the temperatures normally encountered in membrane cell operations, i.e., from about 90° to about 105° C., the chemical reaction between the chlorate ion and the acid medium proceeds quite rapidly especially when an excess of acid is applied. However, when dealing with continuous flow types of processes such as those encountered in membrane chlor-alkali cell operations, a certain period of "residence" is required in the reactor to allow sufficient time for the reaction to be completed. It has been found that in high velocity reactors wherein good mixing between the liquor and acid solutions can be easily achieved, "residence times" as short as about 20–30 minutes are adequate to substantially remove all chlorate ions present. In slower velocity systems, the time required is extended to between about 80 to 110 minutes. However, it is also found that as residence time increases, the amount of acid required to achieve a given level of chlorate ion removal decreases. The treated solution is returned to the process stream via line 57.

The exact values of brine velocity and residence time are not critical and will depend upon the operating and equipment parameters of the system. Whatever these values may be, it will be found that the amount of acid required to achieve a given level of chlorate removal will be substantially lower than that required in prior art methods. Thus the method of this invention permits both substantial simplications in system design and operating economies as compared to the method of Lai et al while still achieving necessary chlorate ion reduction.

Some $ClO_2$ will normally be created during these reactions which must be controllably reduced to $Cl_2+O_2$. Means to do this are well known in the art. The chlorine and oxygen products of the decomposition of chlorine dioxide may be either passed through a scrubber and absorbed in aqueous alkali for sodium hypochlorite production or may be joined to the cell system's chlorine handling system. The sodium chloride salt formed remains dissolved in the solution as it is recycled into the resaturator of the brine system. The chlorate depleted reaction liquor containing excess HCl is utilized to adjust the pH of the cycling brine solution.

It will be recognized that possible additional elements, such as heat exchangers, steam lines, salt filters and washers, mixers, pumps, compressors, holding tanks, etc., have been left out of FIG. 1 for improved understanding but that the use of such auxiliary equipment and/or systems is conventional. Further, such systems such as the dechlorinator and the chlorine handling subsystems are not described in detail since such subsystems are well known in the chlor-alkali industry.

Membrane cells or electrolytic cells using permselective cation hydraulically semi-permeable or impermeable membranes to separate the anode and the cathode during electrolysis are also well known in the art. Within recent years, improved membranes have been introduced and such membranes are preferably utilized in the present invention. These can be selected from several different groups of materials.

A first group of membranes includes amine substituted polymers such as diamine and polyamine substituted polymers of the type described in U.S. Pat. No. 4,030,988, issued on June 21, 1977 to Walther Gustav Grot and primary amine substituted polymers described in U.S. Pat. No. 4,085,071, issued on Apr. 18, 1978 to Paul Raphael Resnick et al. The basic precursor sulfonyl fluoride polymer of U.S. Pat. No. 4,036,714, issued on July 19, 1977 to Robert Spitzer, is generally utilized as the basis for those membranes.

A second group of materials suitable as membranes in the process of this invention includes perfluorosulfonic acid membrane laminates which are comprised of at least two unmodified homogeneous perfluorosulfonic acid films. Before lamination, both films are unmodified and are individually prepared in accordance with the basic '714 patent previously described.

A third group of materials suitable as membranes in the process of this invention includes homogeneous perfluorosulfonic acid membrane laminates. These are comprised of at least two unmodified perfluorosulfonic acid films of 1200 equivalent weight laminated together with an inert cloth supporting fabric.

A fourth group of membranes suitable for use as membranes in the process of this invention include carboxylic acid substituted polymers described in U.S. Pat. No. 4,065,366, issued to Oda et al on Dec. 27, 1977.

EXAMPLES 1–7

The process of this invention was performed in a series of simulated flow through treatments using a brine comprised of 300 g/l (5.1 molar) NaCl (720 Kg/hr) and 10 g/l (0.1 molar) $NaClO_3$ (24 Kg/hr, 226.4 mols/hr) at 95° C. A constant flow rate of 2.4 $m^3$/hr (2832 Kg/hr) was used. Treatment comprised adding a preselected amount of 32% (9 molar) HCl to the brine and holding the mix for a residence time equal to that found with 500, 750 or 1000 gallon reactors. At the conclusion of the residence time, the residual $NaClO_3$ and the $Cl_2$ and $ClO_2$ generated were measured with the results tabulated in Table 1.

TABLE 1

| Example | Reactor Volume (Gallons) | HCl Feed (Kg/hr) | HCl Feed (Mols/hr) | Residence Time (Min.) | $Cl_2$ Out (Kg/hr.) | $ClO_2$ Out (Kg/hr.) | $NaClO_3$ Out (Kg/hr.) | % $NaClO_3$ Reduction |
|---|---|---|---|---|---|---|---|---|
| 1 | 500 | 531 | 4779 | 39.8 | 35.6 | 4.5 | 0.3 | 98.5 |
| 2 | 500 | 413 | 3719 | 41.3 | 35.1 | 4.4 | 0.6 | 97 |
| 3 | 500 | 295 | 2655 | 42.8 | 33.5 | 4.2 | 1.7 | 94 |
| 4 | 500 | 260 | 2340 | 43.3 | 32.3 | 4.1 | 2.4 | 90 |
| 5 | 750 | 236 | 2124 | 65.5 | 32.5 | 4.1 | 2.4 | 90 |
| 6 | 1000 | 224 | 2016 | 87.7 | 32.6 | 4.1 | 2.2 | 91 |

TABLE 1-continued

| Example | Reactor Volume (Gallons) | HCl Feed (Kg/hr) | HCl Feed (Mols/hr) | Residence Time (Min.) | $Cl_2$Out (Kg/hr.) | $ClO_2$ Out (Kg/hr.) | $NaClO_3$ Out (Kg/hr.) | % $NaClO_3$ Reduction |
|---|---|---|---|---|---|---|---|---|
| 7 | 1000 | 218 | 1916 | 87.9 | 32.3 | 4.1 | 2.4 | 90 |

Feed stock solution = 0.1 M $NaClO_3$, 5.1 M NaCl
Feed Rate = 2.4 Kg/hr. $NaClO_3$
Feed Rate = 226.4 Mols/hr. $NaClO_3$ The brine solution used in these experimental runs is about 0.1 molar or 226 mols/hr. To treat the 240 Kg/hr of $NaClO_3$ passing through the reactor, 1356 mols HCl are required to reach the stoichiometric ($H^+/ClO_3^-$) ratio of 6:1. For 32% (9 molar) HCl that requires a minimum HCl feed rate of about 151 Kg/hr. These state that on a 500 gal/hr reactor having a relatively short residence time about a 66% molar excess of acid will reduce the $ClO_3$ ion content by 90%. Further as shown by EXAMPLES 1 and 4, doubling this ratio will reduce the initial $ClO_3$ ion content by about 99% in this time. These effects are enhanced by increasing the residence time as shown in EXAMPLE 7, the acid excess is needed to reach 90% chlorate removal declines to about 45%. The economics of plant design and raw material costs will determine the particular flow rate and residence time which should be used for optimum results.

EXAMPLE 8

A 2.0 l sample at 90° C. of substantially dechlorinated brine containing 338.8 g/l NaCl and 5.23 g/l (0.098 molar) $NaClO_3$ was treated with a 35% (10 molar) HCl solution to remove the $ClO_3$ ion present. The results are as follows:

| $NaClO_3$ Total | HCl Added (ml) |
|---|---|
| 10.46 | 0 |
| 10.4 | 10 |
| 10.16 | 20 |
| 9.9 | 30 |
| 4.84 | 55 |
| 2.24 | 70 |
| 1.02 | 80 |
| Trace | 90 |

COMPARATIVE TEST A A 2.0 liter sample at 90° C. of dechlorinated but unsaturated brine containing 196.2 g/l NaCl and 5.03 g/l (0.96 molar) $NaClO_3$ was treated with 35% (10 molar) HCl. A brine solution of this composition is similar to that used in the method of Lai et al and the results obtained were:

| $NaClO_3$ Total | HCl Added (ml) |
|---|---|
| 10.06 | 0 |
| 9.9 | 25 |
| 9.46 | 50 |
| 6.88 | 75 |
| 5.66 | 100 |
| 2.96 | 120 |
| 1.86 | 150 |
| 0.83 | 170 |
| Trace | 190 |

The data obtained in Example 8 show that the effectiveness of chlorate ion removal is substantially improved when acid treatment as disclosed in this present invention is conducted after brine resaturation, as compared to the data of Comparative Test A, corresponding to the prior art which teaches such treatment before resaturation. In the examples given, the present method required less than half as much acid as the prior art method.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. In a process for purifying an alkali metal halide brine liquor used in the production of an alkali metal hydroxide and a halogen by electrolysis in a membrane cell having an anolyte and a catholyte compartment, said alkali metal halide brine liquor being circulated through said anolyte compartment during electrolysis, wherein alkali metal halates are produced within said brine liquor, said brine liquor then being recovered from said cell, dehalogenated, and resaturated with additional alkali metal halide, and recycling the resaturated brine liquor to said anolyte compartment, the improvement comprising:

(a) diverting a portion of said resaturated brine liquor after said dehalogenation and resaturation steps have been completed, said diverted portion being at a temperature of between about 90° to about 105° C.;

(b) contacting said diverted portion with at least a stoichiometric amount of hydrochloric acid for a residence time sufficient to reduce essentially all of the alkali metal halate within said portion to halogen and alkali metal halide; and (c) combining said contacted portion with said brine liquor recovered from said cell to reduce the total alkali metal halate content of the resulting combined stream to an acceptable level.

2. The process of claim 1 wherein between about 10 and about 30% of said resaturated brine liquor is diverted.

3. The process of claim 2 wherein between about 12 and 25% of said resaturated brine liquor is diverted.

4. The process of claim 1 wherein said acid is hydrochloric acid.

5. The process of claim 4 wherein said acid is added in an amount of about 6 to about 10 moles per mole of alkali metal halate in said diverted portion.

6. The process of claim 1 wherein said residence time is between about 20 and about 90 minutes.

7. The process of claim 1 wherein the aqueous alkali metal halide brine is sodium chloride brine, the alkali metal halate is sodium chlorate and said halogen is chlorine.

8. A process for purifying a sodium chloride brine liquor for use in the electrolytic production of sddium hydroxide and chlorine which comprises decomposing sodium chloride brine by electrolysis in an electrolytic cell comprising an anolyte compartment, a catholyte compartment and a permselective cationic membrane separating said anolyte compartment from said catholyte compartment, recovering a deplete brine containing sodium chlorate from said anolyte compartment, dechlorinating and resaturating said depleted brine and returning said resaturated brine to said anolyte compartment, diverting from about 10 to about 30 percent of said resaturated brine before returning to said anolyte compartment and contacting said diverted portion with between about 6 and about 10 moles of hydrochloric acid per mole of sodium chlorate in said liquor to substantially decompose the sodium chlorate therein, recombining said contacted diverted portion with said depleted brine recovered from said anolyte compartment to reduce the total sodium chlorate content therein to an acceptable level prior to said depleted brine being resaturated and recycled to said anolyte compartment.

* * * * *

UNITED STATES PATENT AND TRADEMARK OFFICE

CERTIFICATE OF CORRECTION

PATENT NO. : 4,481,088

DATED : November 6, 1984

INVENTOR(S) : Sanders H. Moore and Ronald L. Dotson

It is certified that error appears in the above-identified patent and that said Letters Patent is hereby corrected as shown below:

In Column 1, line 23, delete "Further" and insert --Following--.

In Column 4, line 38, delete "$Fe^{30+}$" and insert --$Fe^{++}$--.

In Column 9, Claim 8, line 2, delete "sddium" and insert --sodium--.

Signed and Sealed this

*Ninth* Day of *April 1985*

[SEAL]

*Attest:*

DONALD J. QUIGG

*Attesting Officer* *Acting Commissioner of Patents and Trademarks*